US011759696B1

(12) United States Patent
Carter

(10) Patent No.: US 11,759,696 B1
(45) Date of Patent: Sep. 19, 2023

(54) INLINE SKATE GRINDING SOULPLATE

(71) Applicant: Shawn Carter, Snohomish, WA (US)

(72) Inventor: Shawn Carter, Snohomish, WA (US)

( * ) Notice: Subject to any disclaimer, the term of this patent is extended or adjusted under 35 U.S.C. 154(b) by 0 days.

(21) Appl. No.: 17/836,885

(22) Filed: Jun. 9, 2022

(51) Int. Cl.
*A63C 5/04* (2006.01)
*A63C 17/26* (2006.01)
*A63C 17/06* (2006.01)

(52) U.S. Cl.
CPC ..... *A63C 17/26* (2013.01); *A63C 17/06* (2013.01); *A63C 2201/02* (2013.01)

(58) Field of Classification Search
CPC .. A63C 2201/02; A63C 17/26; A63C 17/0006
See application file for complete search history.

(56) References Cited

U.S. PATENT DOCUMENTS 6,006,450 A * 12/1999 Hayes ..... A43B 5/00 36/107
6,029,983 A * 2/2000 Wegener ..... A63C 17/06 280/811
6,070,887 A * 6/2000 Cornelius ..... A63C 17/06 280/11.27
6,115,946 A * 9/2000 Morris ..... A43B 13/24 36/72 A
6,863,284 B2 * 3/2005 Wegener ..... A63C 17/06 280/11.3
2001/0013695 A1 * 8/2001 Borel ..... A43B 5/0403 280/607
2006/0113735 A1 * 6/2006 Hyser ..... A63C 17/06 280/11.221
2009/0026720 A1 * 1/2009 Wegener ..... A63C 17/06 280/11.223
2009/0085313 A1 * 4/2009 Landry ..... A63C 17/18 280/11.18
2009/0146386 A1 * 6/2009 Raser ..... A63C 17/06 280/11.221

* cited by examiner

*Primary Examiner* — Brian L Swenson
(74) *Attorney, Agent, or Firm* — Plager Schack LLP; Mark H. Plager; Kara K. Verryt

(57) ABSTRACT

An inline skate boot contouring designed for improved grinding capabilities may include a soul plate with an inner edge and an outer edge, the inner edge being configured to abut a frame on an inline skate boot during use, wherein the soul plate includes a toe end, a heel end, and a middle portion positioned between the toe end and the heel end; a soul grind angle face extending upward from the outer edge of the soul plate at an angle greater than 90° with respect to a plane of the frame; a cess slide face extending upward from an outer edge of the soul grind angle face at an angle greater than 90° with respect to the frame; and a backslide surface extending upward from a top edge of the cess slide face such that a distal edge of the backslide surface is configured to abut the inline skate boot during use.

6 Claims, 3 Drawing Sheets

INLINE SKATE GRINDING SOULPLATE

BACKGROUND

The embodiments described herein relate generally to inline skating and, more particularly, to an inline skate soul/sole plate designed specification for grinding.

Traditionally, inline skates have a 90-degree angle from the frame to the soul/sole area located on the outside of the foot. Ledges are also usually 90 degrees. Thus, the existing soul plates are not angled properly for grinding on a ledge, because the contact area is on the outside edge of the skater's body, making it hard to balance. In fact, a skater can generally only balance for a few seconds while performing a sole/soul grind while wearing inline skates with traditional soul plates.

Therefore, what is needed is an inline skate soul plate that is designed specifically for grinding, wherein the soul plate has more than one angle from the frame to the soul/sole grinding area for inline skates and wherein the angle from the soul plate to the frame is over 90 degrees.

SUMMARY

Some embodiments of the present disclosure include a inline skate soul plate designed for improved grinding capabilities. The inline skate soul plate may include a soul plate with an inner edge and an outer edge, the inner edge being configured to abut a frame on an inline skate boot during use, wherein the soul plate includes a toe end, a heel end, and a middle portion positioned between the toe end and the heel end; a soul grind angle face extending upward from the outer edge of the soul plate at an angle greater than 90° with respect to a plane of the frame; a cess slide face extending upward from an outer edge of the soul grind angle face at an angle greater than 90° with respect to the plane of the frame; and a backslide surface extending upward from a top edge of the cess slide face such that a distal edge of the backslide surface is configured to abut the inline skate boot during use.

BRIEF DESCRIPTION OF THE FIGURES

The detailed description of some embodiments of the invention is made below with reference to the accompanying figures, wherein like numerals represent corresponding parts of the figures.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as an inline skate grinding soul plate and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

The various elements of the present disclosure may be related in the following exemplary fashion. It is not intended to limit the scope or nature of the relationships between the various elements, and the following examples are presented as illustrative examples only.

Figure 1:
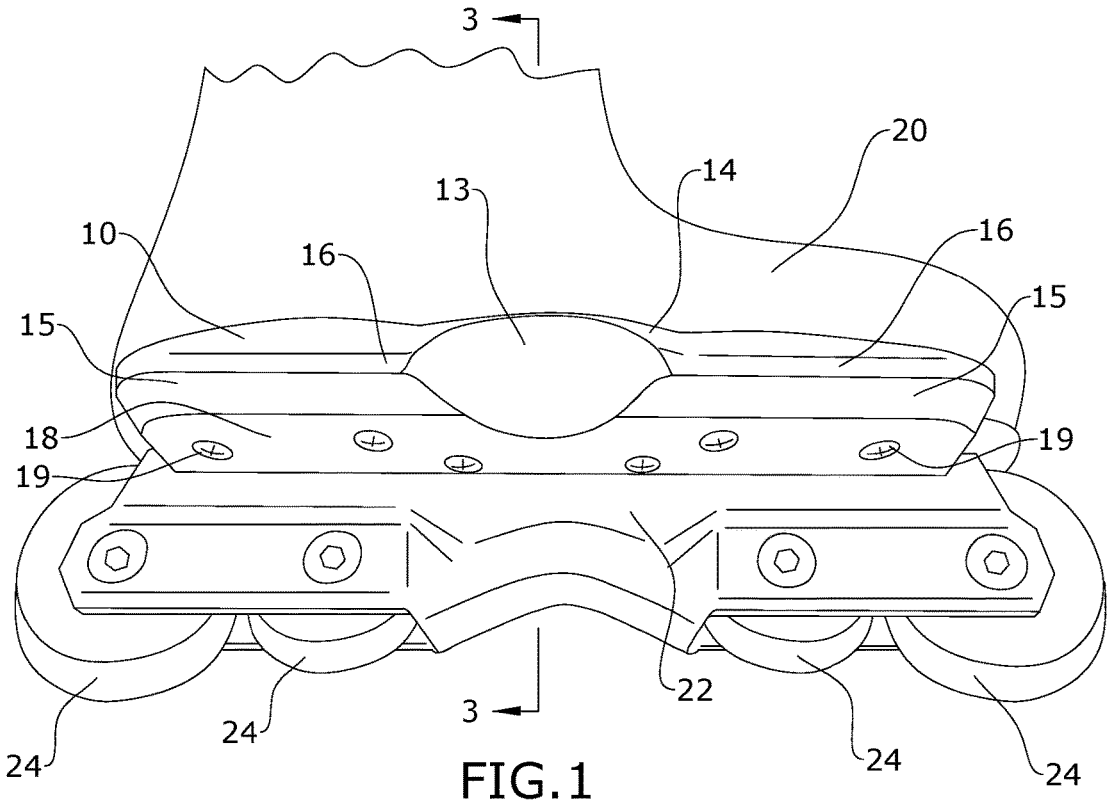
FIG. 1 is a perspective view of one embodiment of the present disclosure, installed on an inline skate boot 20.
Figure 2:
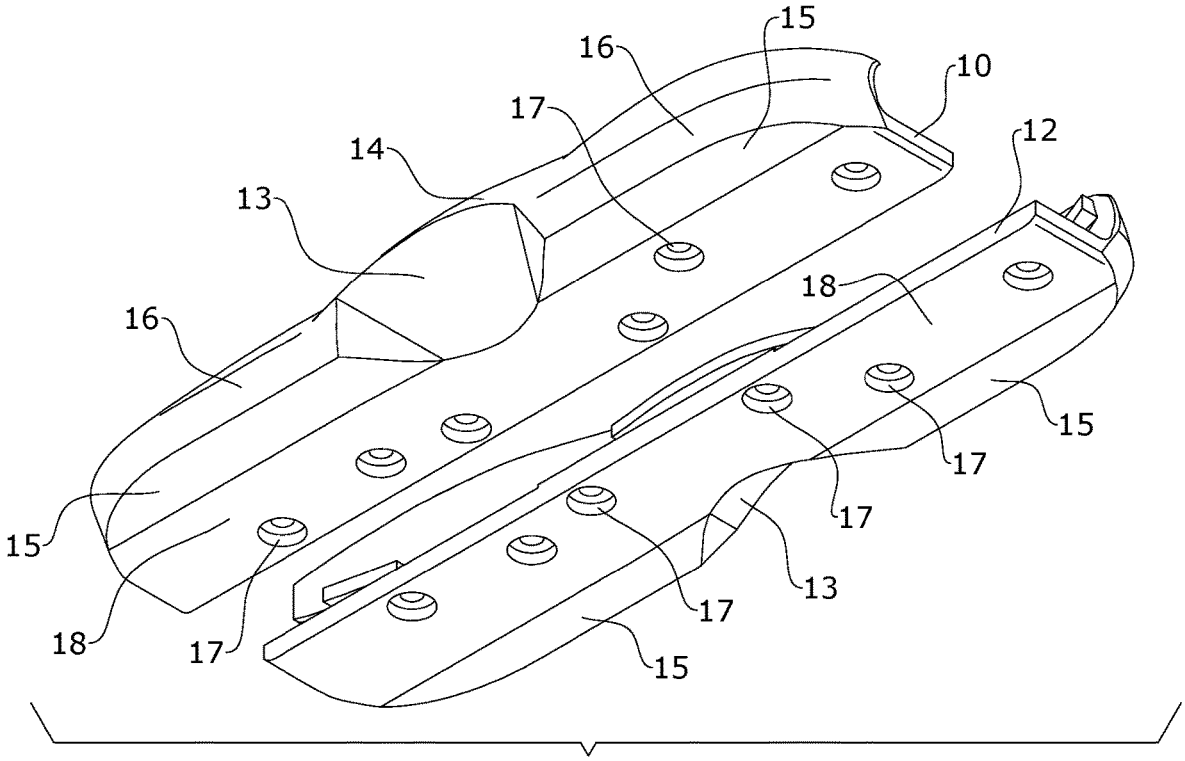
FIG. 2 is a perspective view of one embodiment of the present disclosure.
Figure 3:
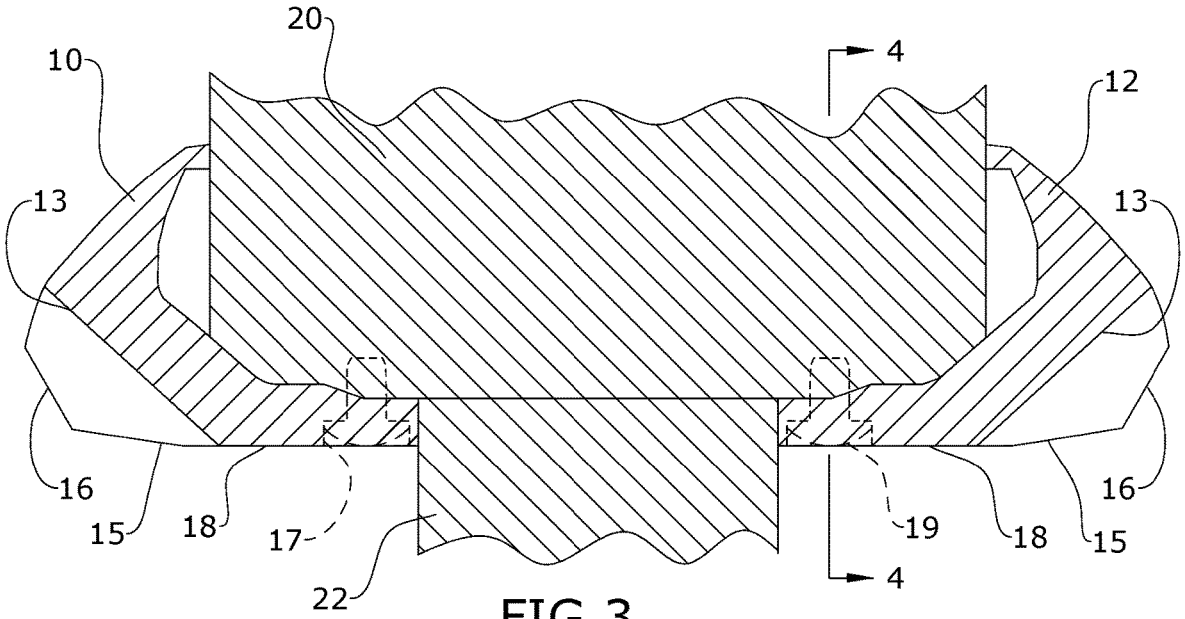
FIG. 3 is a section view of one embodiment of the present disclosure, taken along line 3-3 in FIG. 1.
Figure 4:
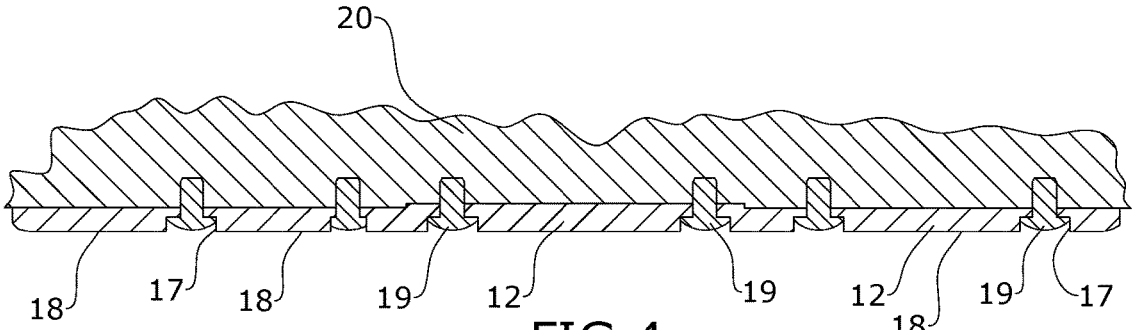
FIG. 4 is a section view of one embodiment of the present disclosure, taken along line 4-4 in FIG. 3.
Figure 5:
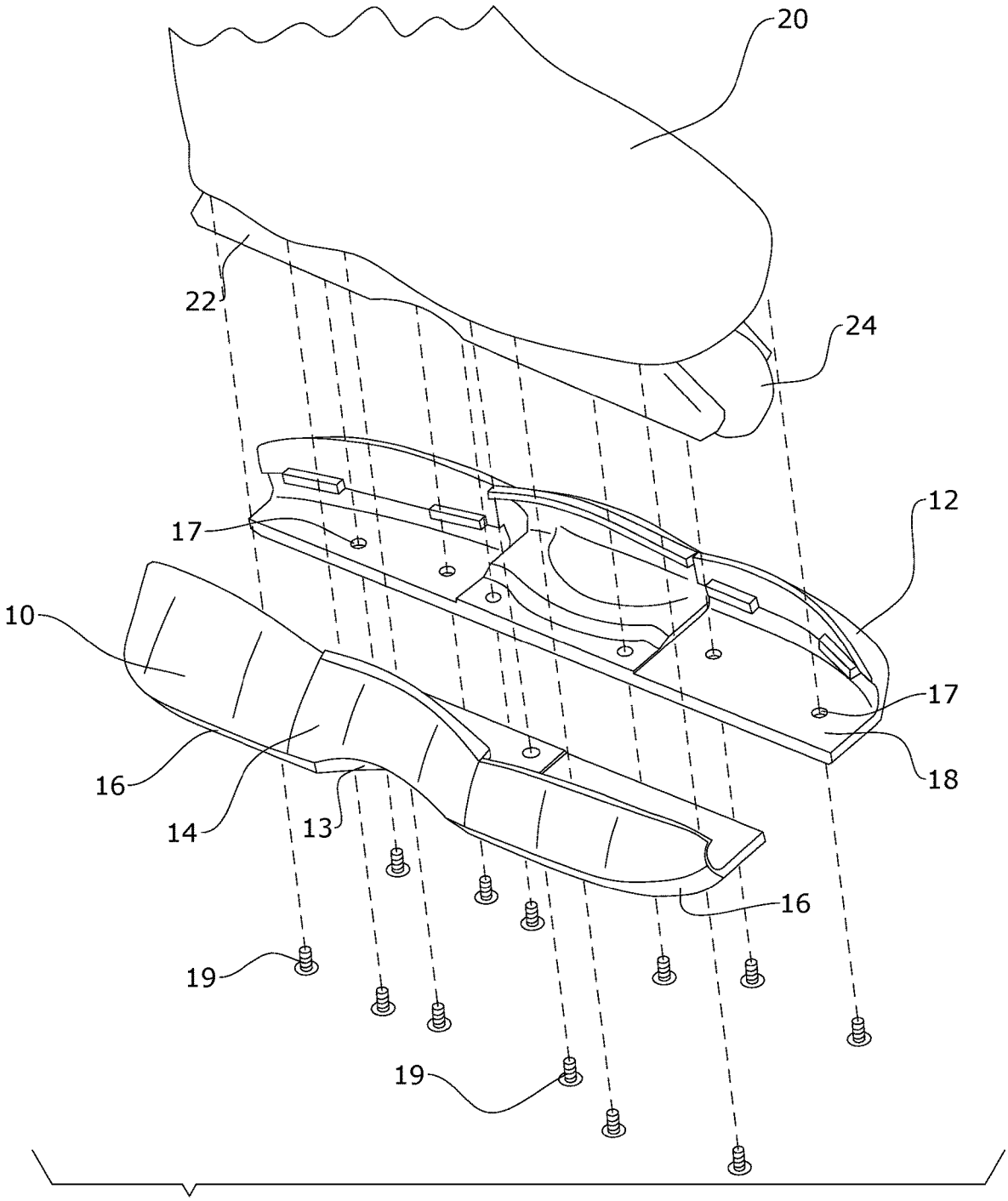
FIG. 5 is an exploded view of one embodiment of the present disclosure.

By way of example, and referring to FIGS. 1-5, some embodiments of the present disclosure include an inline skate soul plate designed specifically for improved grinding capabilities. In embodiments, the inline skate soul plate may comprise an outer boot contouring 10 and an inner boot contouring 12 configured to be attached a bottom surface of an inline skate boot 20 on opposite sides of a frame 22 extending downward therefrom, wherein the frame 22 supports a plurality of wheels 24. As shown in the Figures, the outer boot contouring 10 and the inner boot contouring 12 may be mirror images of one another.

In embodiments, the outer boot contouring 10 may comprise a soul plate 18 comprising a plurality of fastener orifices 17 extending therethrough. The soul plate 18 may be substantially planar, such that it closely approximates the shape of the bottom of the boot 20. The soul plate 18 may have a toe end proximate to the toe of the boot 20, a middle portion, and a heel end proximate to a heel of the boot 20. The soul plate 18 may include an inner edge configured to be positioned against the frame 22 and an outer edge opposite the inner edge. The outer boot contouring 10 may comprise a soul grind angle face 15 angled upward from the outer edge of the soul plate 18 between the toe end and middle portion of the soul plate 18 and between the heel end and the middle portion of the soul plate 18, wherein a break in the soul grind angle face 15 at the middle portion of soul plate defines a bottom portion of a backslide plate 13. As shown in at least FIG. 3, the soul grind angle face 15 may extend from the outer edge of the faceplate 18 at a slight angle, such that the soul grind angle face 15 is not planar with the soul plate 18. For example, the soul grind angle face 15 may extend upward at an angle of from about 3 to about 45° with respect to the soul plate 18.

As shown in the Figures, a cess slide face 16 may extend upward from an outer edge of the soul grind angle face 15. In embodiments, the cess slide face 16 extends upward at an angle less than that required for the cess slide face 16 to be perpendicularly oriented with respect to the soul plate 18. For example, the cess slide face 16 may extend upward at an angle that is greater than that of the soul grind angle face 15.

As also shown in the Figures, a back slide surface 14 may extend from a top edge (or outer edge) of the cess slide face 16 back toward the boot 20. In use, the distal edge of the back slide surface 14 may abut a side surface of the boot 20.

As mentioned above, the outer boot contouring 10 may comprise a backslide plate 13 extending into a middle portion thereof. Specifically, a break in both the soul angle grind face 15 and the cess slide face 16 in a middle portion of the outer boot contouring 10 may define the backslide plate 13. As such, but for the location of the backslide plate 13, both the soul angle grind face 15 and the cess slide face 16 may extend along an entire length of the boot contouring 10, and the back slide surface 14 may extend along an entire length of the boot contouring 10.

The inner boot contouring 12, as mentioned above, may have a structure that is a mirror image of the outer boot contouring 10. As such, the inner boot contouring 12 may also comprise a soul plate 18, a soul grind angle face 15 extending at an angled upward from an outer surface of the soul plate 18, a cess slide face 16 extending upward from an outer edge of the soul grind angle face 15, and a backslide surface 14 extending from an outer edge of the cess slide face 16 back toward the boot 20. The inner boot contouring 12 may also comprise a backslide plate 13 defined by a break in the soul grind angle face 15 and cess slide face 16 in a central portion7y of the inner boot contouring 12.

The inline skate soul plate of the present disclosure may be made of any suitable or desired materials, such as those commonly used for soul plates and inline skate accessories.

To use the inline skate boot contouring of the present disclosure, an outer boot contouring 10 may be attached to an outer portion of the soul of an inline skate boot 20, such that an inner edge of the soul plate 18 abuts the frame 22. The outer boot contouring 10 may be attached to the boot 10 using a plurality of fasteners 19 extending through the fastener orifices 17 in the soul plate 18. An inner boot contouring 12 may similarly be attached to an inner portion of the soul of the inline skate boot 20. The user may then place the inline skates on his or her feet and perform various slides and tricks using the varying surfaces of the soul plates.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. An inline skate boot contouring designed for improved grinding capabilities, the boot contouring comprising:

a plate with an inner edge and an outer edge, the inner edge being configured to abut a frame on an inline skate boot during use, wherein the plate comprises a toe end, a heel end, and a middle portion positioned between the toe end and the heel end;

a grind angle face extending upward from the outer edge of the plate at an angle greater than 90° with respect to a plane of the frame;

a slide face extending upward from an outer edge of the grind angle face at an angle greater than 90° with respect to the plane of the frame; and a backslide surface extending upward from a top edge of the slide face such that a distal edge of the backslide surface is configured to abut the inline skate boot during use.

2. The inline skate boot contouring of claim 1, further comprising a break in both the grind face and the slide face proximate to the middle portion of the plate.

3. The inline skate boot contouring of claim 2, wherein the break comprises a rounded cutout.

4. The inline skate boot contouring of claim 1, further comprising a plurality of fastener orifices extending through the plate.

5. The inline skate boot contouring of claim 1, wherein the grind angle face extends upward from the plate at an angle of about 3 to about 45°.

6. The inline skate boot contouring of claim 5, wherein the slide face extends upward from the grind angle face at an angle greater than the angle at which the grind angle face extends from the plate.

* * * * *